US010327540B2

(12) United States Patent
Lamothe et al.

(10) Patent No.: US 10,327,540 B2
(45) Date of Patent: Jun. 25, 2019

(54) MOBILE TOOTHBRUSH HOLDER

(71) Applicant: MAXOR INC., Drummondville (CA)

(72) Inventors: Denis Lamothe, Drummondville (CA); Jean Lamothe, Drummondville (CA)

(73) Assignee: ,AXOR INC., Drummond Ville (CA)

( * ) Notice: Subject to any disclaimer, the term of this patent is extended or adjusted under 35 U.S.C. 154(b) by 0 days.

(21) Appl. No.: 15/562,765

(22) PCT Filed: Apr. 13, 2016

(86) PCT No.: PCT/CA2016/050426

§ 371 (c)(1),
(2) Date: Sep. 28, 2017

(87) PCT Pub. No.: WO2016/165015

PCT Pub. Date: Oct. 20, 2016

(65) Prior Publication Data

US 2018/0078030 A1 Mar. 22, 2018

(30) Foreign Application Priority Data

Apr. 13, 2015 (CA) ..... 2887531

(51) Int. Cl.

| | |
|---|---|
| ***A46B 17/04*** | (2006.01) |
| ***A47G 29/08*** | (2006.01) |
| ***A46B 17/02*** | (2006.01) |

(52) U.S. Cl.

CPC ..... *A46B 17/04* (2013.01); *A46B 17/02* (2013.01); *A47G 29/08* (2013.01); *A46B 2200/1066* (2013.01)

(58) Field of Classification Search

CPC ..... A46B 17/04; A46B 17/06; A46B 17/00; A46B 15/0095; A47B 81/02; A45D 44/18; A47K 1/09; B65D 81/22

USPC ..... 206/361, 15.2, 15.3, 362.3, 207, 209, 206/209.1; 220/4.21, 4.22, 4.23

See application file for complete search history.

(56) References Cited

U.S. PATENT DOCUMENTS 1,911,781 A * 5/1933 Wolfe, Jr. ..... A47L 13/512 248/113
2,037,608 A * 4/1936 Walker ..... B21D 5/12 219/67
2,157,862 A * 5/1939 Oshman ..... A46B 17/04 206/362.3

(Continued)

FOREIGN PATENT DOCUMENTS

CA 2921888 5/2014
DE 102005056143 7/2006

(Continued)

OTHER PUBLICATIONS

ISR and WO PCT/CA2016/050426.
European Search 16779362.

*Primary Examiner* — Anthony D Stashick
*Assistant Examiner* — L E Kmet
(74) *Attorney, Agent, or Firm* — Gonzalo Lavin

(57) ABSTRACT

An effective assembly for a toothbrush holder is achieved by applying a biasing member's force to cause two portions of an enclosure, each receiving one of two rollers. In this way, the biasing action can be used both for the roller action as well as for keeping the enclosure closed around the toothbrush head.

11 Claims, 6 Drawing Sheets

(56) References Cited

U.S. PATENT DOCUMENTS

| | | | | | |
|---|---|---|---|---|---|
| 2,275,549 | A | * | 3/1942 | Oshman | A47K 1/09 206/362.3 |
| 2,309,116 | A | * | 1/1943 | Hylen | A47K 1/09 206/15.3 |
| 2,311,222 | A | * | 2/1943 | Galkin | D05B 21/002 112/309 |
| 2,331,222 | A | * | 10/1943 | Oshman | A46B 17/04 206/362.3 |
| 2,507,342 | A | * | 5/1950 | Licari | A47K 1/09 15/DIG. 9 |
| 2,531,066 | A | | 11/1950 | Metuchen | |
| 2,600,345 | A | * | 6/1952 | Venditti | A47K 1/09 206/362.3 |
| 2,937,910 | A | | 5/1960 | Randa | |
| 4,106,152 | A | * | 8/1978 | Hadary | A46B 7/02 132/308 |
| 5,922,292 | A | | 7/1999 | Hecker | |

FOREIGN PATENT DOCUMENTS

| | | |
|---|---|---|
| DE | 102006017648 | 10/2007 |
| GB | 571360 | 8/1945 |
| GB | 2462647 | 2/2010 |
| WO | WO9835585 A1 | 8/1998 |
| WO | WO2007020660 | 2/2007 |
| WO | WO2014078953 | 5/2014 |

* cited by examiner

MOBILE TOOTHBRUSH HOLDER

CROSS-REFERENCE TO RELATED APPLICATIONS

This application is a National Entry Application of PCT application no CA2016/050426 filed on Apr. 13, 2016 and published in English under PCT Article 21(2), which itself claims benefit of Canadian application Serial No. 2,887,531, filed on Apr. 13, 2015. All documents above are incorporated herein in their entirety by reference.

TECHNICAL FIELD

The present application relates to toothbrush holders.

BACKGROUND

A toothbrush holder providing protection for a toothbrush head in known in Applicant's published PCT patent application WO2014/078953 (MAUFETTE et al.) published May 30, 2014. In many embodiments of that patent application, a pair of juxtaposed rollers is provided at the ends of biased arms. The rollers allow for the easy insertion and removal of the toothbrush head from an enclosure for storage. In some embodiments, the rollers are shaped concavely to keep the sides of the toothbrush head aligned or guided during insertion and removal, with the benefit that the toothbrush is unlikely to twist with the result that bristles of the toothbrush contact the holder or its enclosure during insertion, storage and/or removal.

U.S. Pat. No. 2,937,910 (Randa) discloses a toothbrush holder with a pair of jaws gripping the toothbrush by its neck. The jaws include two cylindrical pins that are spaced from each other and are mounted in place by resilient side strips that flex when the toothbrush is inserted or removed. These resilient side strips form a passage between the strips for insertion and removal of the toothbrush. However, the side strips come into direct contact with the toothbrush head which leads to hygienic problems as the inside of Randa's holder becomes contaminated by the toothbrush head rubbing against the inside of the holder.

SUMMARY

According to the present invention, there is provided a toothbrush holder for holding an individual toothbrush having a head with bristles and a handle, the holder comprising: an enclosure comprising complementary enclosure parts articulated relative to one another to separate while receiving said head and come together when said head is stored within said enclosure, said enclosure being dimensioned for storing said head while providing a spacing between said bristles and an inner side of the enclosure for hygienic purpose; a guide member cooperating with said enclosure parts for guiding said head during insertion and removal of said head into and out of said enclosure; and a biasing member interacting with said enclosure parts for biasing said enclosure parts to be closed, said guide member facilitating said insertion of said head by forcing said enclosure parts to separate against the action of the biasing member.

In embodiments, the toothbrush holder is configured so that when said head is inserted within said enclosure, said guide member and enclosure parts being biased by said biasing member retain said head within said enclosure while leaving a portion of said handle outside said enclosure.

In embodiments, said guide member comprises a roller mounted on each of said enclosure parts for guiding said head. Thereby, said biasing member's force can be used both for the roller action as well as for keeping the enclosure closed around the toothbrush head.

BRIEF DESCRIPTION OF THE DRAWINGS

The various embodiments disclosed herein will be better understood by way of the following detailed description with reference to the appended drawings, in which.

DETAILED DESCRIPTION

When a factory-fresh toothbrush is first used, it provides a sense of comfort that it is clean and safe to use. Once it is used, it has come in contact with oral bacteria and any other germs present in the oral cavity. Rinsing the toothbrush gives some sense of hygiene, however, there is a lingering sense that bristles of an exposed toothbrush head may contain remnant bacteria or germs from the oral cavity and may attract airborne germs as well.

Giving the user a feeling of comfort and security in storage of the toothbrush involves providing a way for the toothbrush to be stored without exposure of the bristles to airborne contaminants and with protection of the bristles against physical contact with other objects.

Figure 1A:
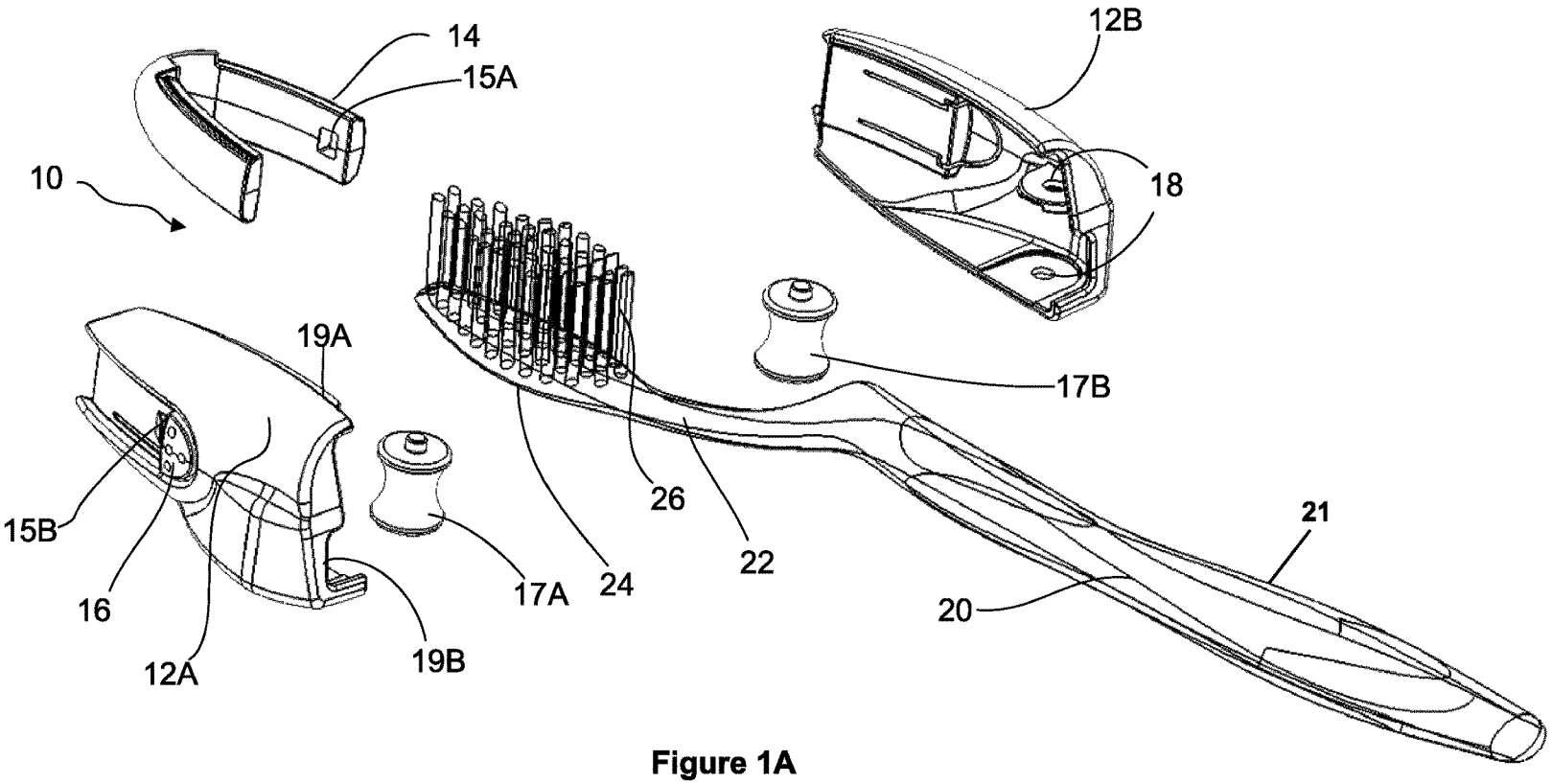
FIG. 1A is an exploded oblique view of various parts making up one embodiment of the toothbrush holder with a toothbrush.
Figure 1B:
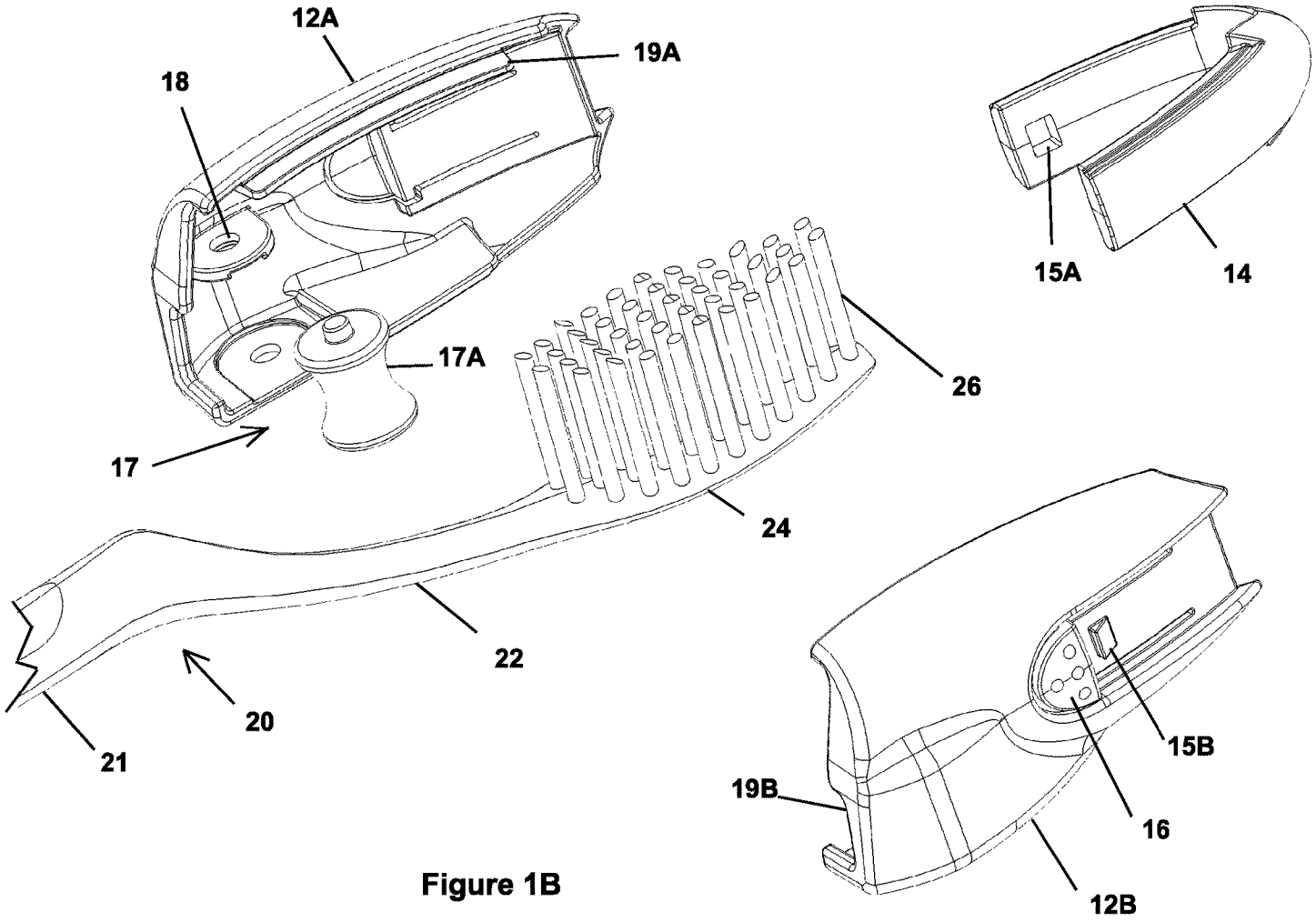
FIG. 1B is another exploded oblique view of various parts making up one embodiment of the toothbrush holder with a toothbrush.

As shown in FIGS. 1A and 1B, the toothbrush 20 is a standard toothbrush having a neck portion 22 connecting a handle 21 to a head portion 24 supporting bristles 26. While the toothbrush shown is of a conventional design, it is possible to constrain the use of the holder 10 to specific toothbrush designs instead of attempting to make it universal, namely suitable for the majority of commercially sold toothbrushes.

Figures 2A, 2B, 2C:
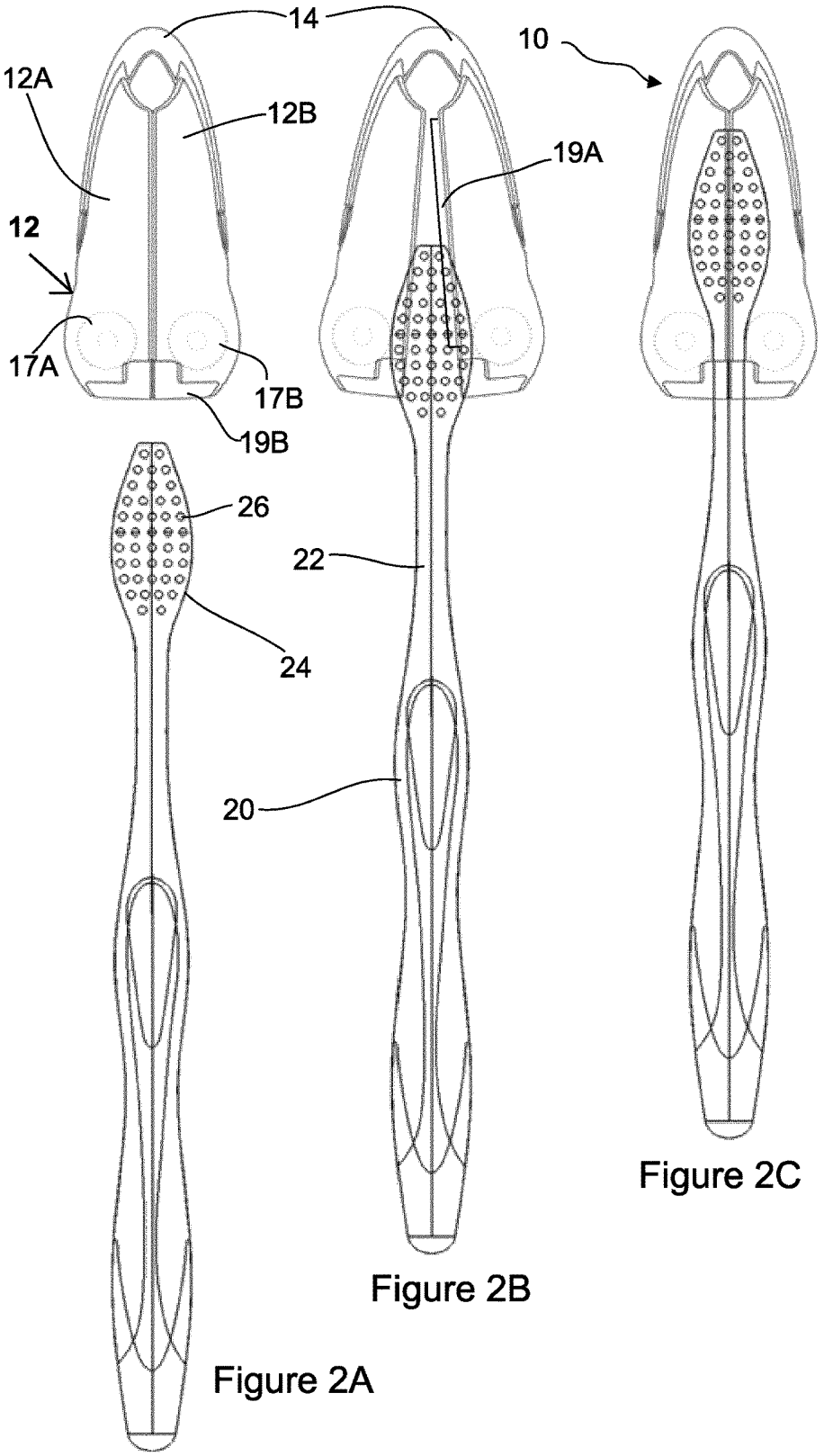
FIG. 2A is a front elevation view of the holder of FIG. 1A shown while the toothbrush head is about to be inserted into the holder, the view showing in outline the rollers inside the enclosure parts.
FIG. 2B is a front elevation view of the holder of FIG. 1A shown while the toothbrush head is being inserted into the holder with the enclosure partly expanded, the view showing in outline the rollers inside the enclosure parts.
FIG. 2C is a front elevation view similar to FIG. 2A with the toothbrush head is fully inserted and the enclosure closed around the toothbrush head.

According to a preferred embodiment, the holder 10 includes two enclosure parts 12A and 12B that form an enclosure 12, shown in FIG. 2A, for providing protection to the bristles 26 against contact with foreign objects. In the embodiment illustrated, the enclosure parts 12A and 12B are substantially similar in shape. Alternatively, at least one part 12A, 12B may have a portion that is has a flat side for wall mounting or for resting on a flat surface, while another portion of at least one part 12A, 12B may be shaped to have a rounded surface so as to enclose the toothbrush 20. Using substantially similar shapes is convenient for a compact holder 10 that can be stored on the counter, in a travel bag or in a drawer.

The enclosure shells or parts 12A and 12B in the embodiment shown are structured to close with minimal gaps or openings around the head 24 and bristles 26. Interlocking flange 19A closes the gap along the parting line between the shells 12A and 12B, while the flange 19B closes the gap around the neck 22 at the entry to the holder 10. It will be understood that the bristles 26 do not contact the upper part of the flange 19B since the insertion of the head 24 causes the enclosure parts 12A and 12B to separate sufficiently to make way for the bristles 26 entering and exiting the enclosure. Advantageously, the parts 12A and 12B are shaped and sized so that the bristles 26 do not touch the inside of the enclosure 12 for hygienic purposes. Indeed, when the head 24 is stored within the enclosure 12, there is provided a spacing between the bristles 26 and the inner side of the enclosure 12 so as to avoid contamination or soiling of the inside of the enclosure 12.

The biasing of the enclosure parts 12A and 12B is provided, in the embodiment shown, by a biasing member such as unitary clip 14. Other spring or biasing mechanisms can be contemplated and other mechanisms to articulate the enclosure parts with respect to one another can also be contemplated.

The clip member 14 is provided with a locking mechanism in the form of recesses 15A on each end of the clip member that engage protrusions 15B. To release the clip 14, buttons 16 can be depressed to disengage the protrusions 15B from the recesses 15A, to allow the clip 14 to be pulled away. It will be appreciated that the clip 14 could have protrusions while the parts 12A and 12B could have corresponding recesses. Likewise, a clip could be provided with a lift tap to allow the user to pull the clip end away from one part 12A and disengage the clip 14. While a suitable release mechanism for the clip 14 is likewise optional, it is used to provide a way for the user to easily disassemble the holder 10 to clean the inside of the holder.

The enclosure parts 12A and 12B cooperate with a guide member 17 mounted thereon for guiding the head 24 during insertion into and removal from the inside of the enclosure 12. The guide member 17 may include guide rollers 17A and 17B that are mounted respectively on each of the enclosure parts 12A and 12B. Suitable bearings, such as for example the ones shown at 18 in FIGS. 1A and 1B are provided. The rollers 17A and 17B may have a depression such as concave surfaces for receiving the sides of the head 24 while guiding the same and preventing twisting of the head 24 as it is inserted and removed from the holder 10. Other roller shapes and designs are contemplated than the one shown, however, it is possible that the roller shape needs to take into account the shape of the head 24 to provide for good guidance of the head during insertion and removal. For example, the rollers 17A and 17B may be flexible so that these are straight in a rest position, but are flexed to present a depression such as a concave depression when the head 24 is inserted or removed from the enclosure 12.

Furthermore, when the sides of a toothbrush head 24 are made of smooth plastic, it is contemplated that the rollers can simply be replaced by suitable fixed guides that allow the sliding insertion of the head 24 to cause the separation of the parts 12A and 12B against the action of the biasing member 14. This requires some cooperation between the materials, the shape of the head 24 and the guide members, as it is less tolerant than the shaped roller design illustrated in the Figures to a more bluntly shaped head 24 or a head made of rubberized material that would offer much higher friction than a smooth plastic material.

The parts shown in FIGS. 1A and 1B can be made of any suitable material, whether plastic or metal.

FIGS. 2A and 2B illustrate how the two enclosure parts 12A and 12B are initially closed and then caused to separate against the action of the clip 14 during insertion of the toothbrush head 24 into the holder 10. The parts 12A and 12B are designed to articulate about a pivot point at their respective tops. As shown in FIG. 2B, when the head 24 is fully inserted, the enclosure parts 12A and 12B are fully enclosed around the head 24 with the clip 14 keeping the parts 12A and 12B securely closed to form an enclosure 12.

While the enclosure 12 shown is shaped to fit relatively snugly around the toothbrush head 24 but without the bristles 26 touching the inside of the enclosure 12, it will be appreciated that the enclosure 12 may be oversized to accommodate a wider variety of toothbrush styles and designs.

Figure 3:
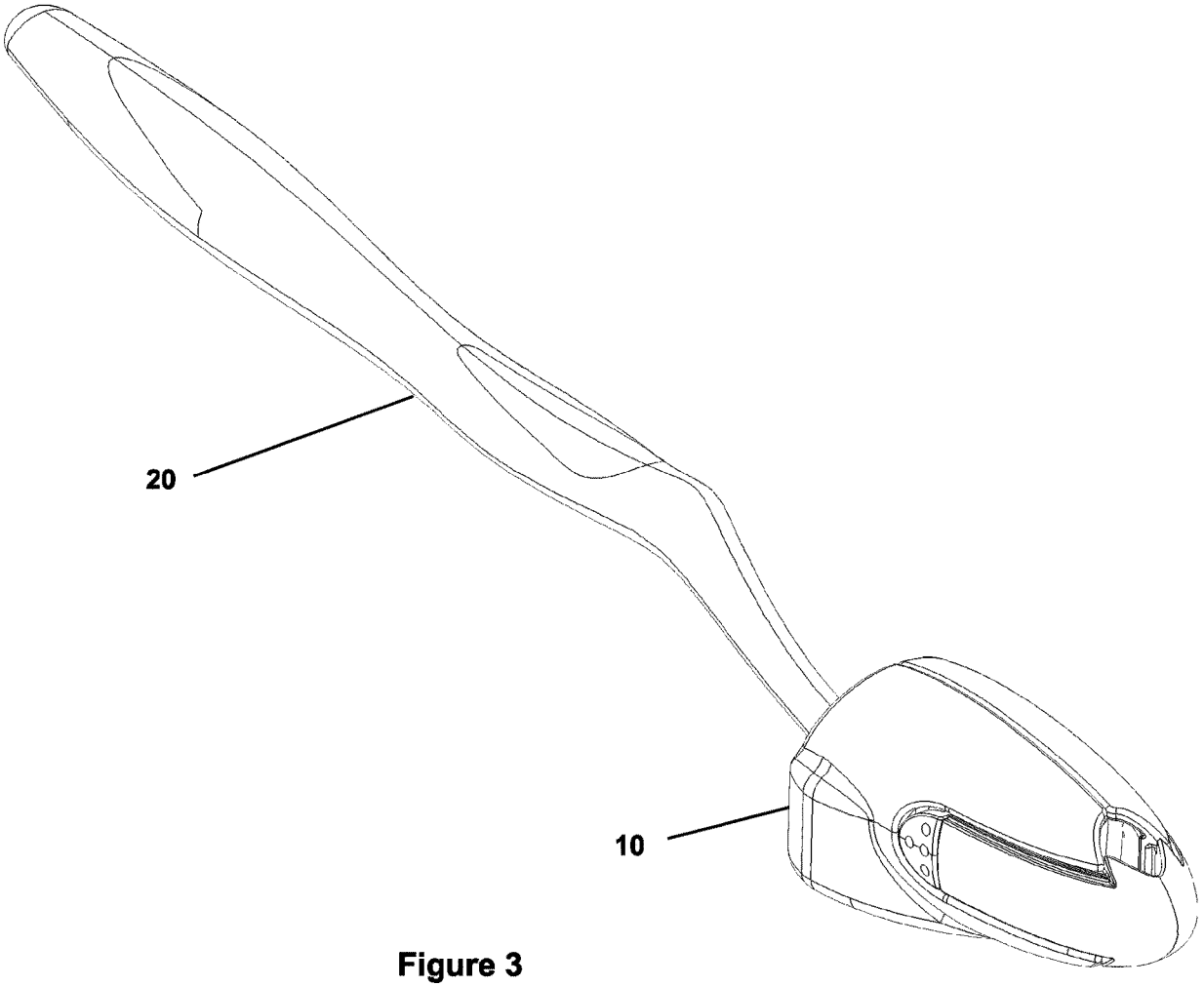
FIG. 3 is a perspective top view of an embodiment of the toothbrush holder with a toothbrush.
Figure 4:
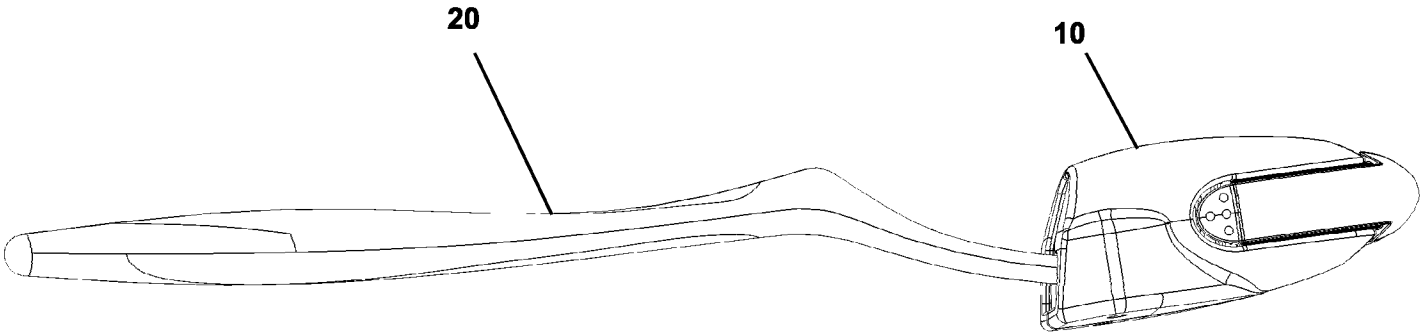
FIG. 4 is a side view of the toothbrush holder with toothbrush shown in FIG. 3.
Figure 5:
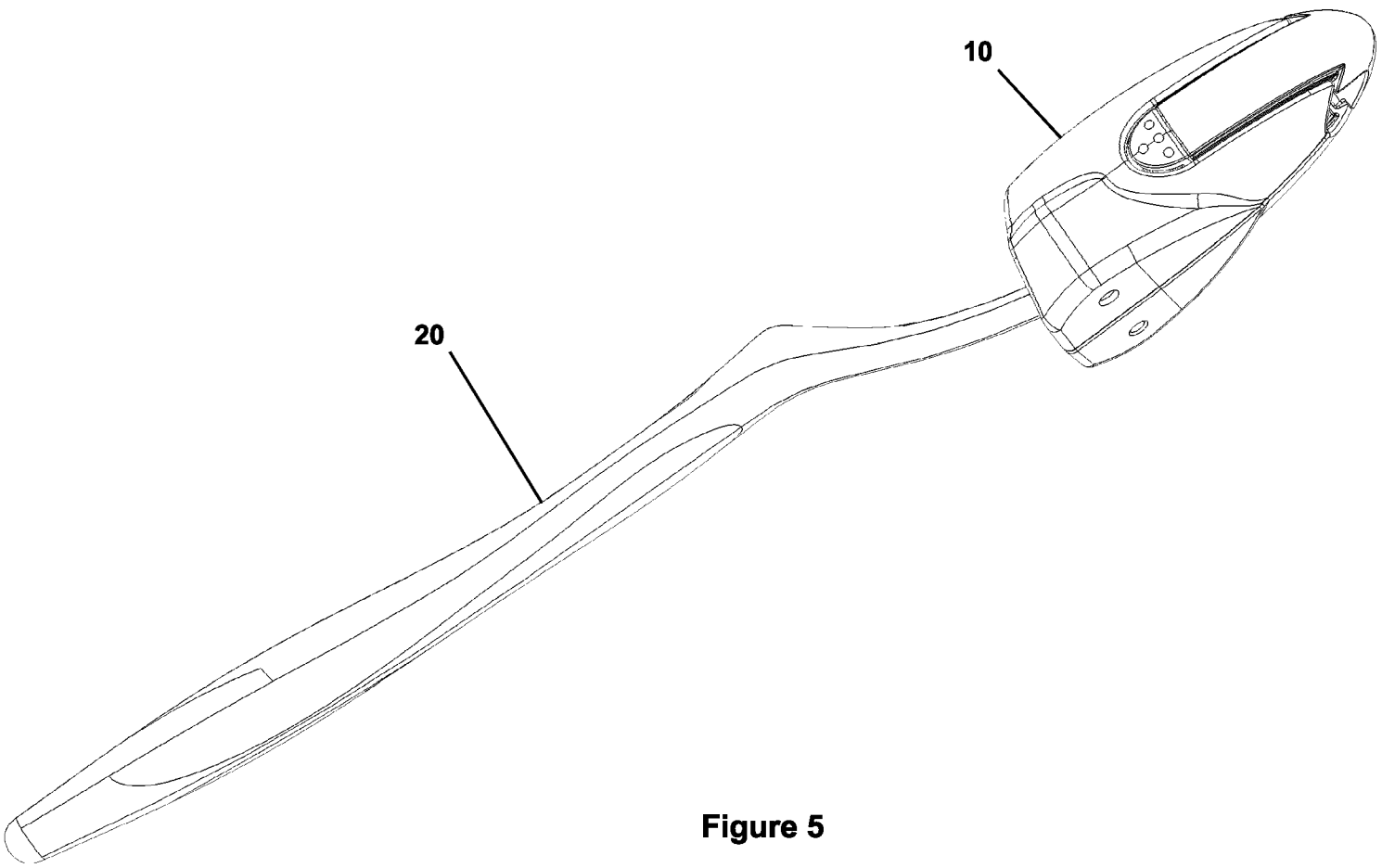
FIG. 5 is a perspective bottom view of the toothbrush holder with toothbrush shown in FIG. 3.

Referring to FIGS. 3 to 5, there is shown different views of an embodiment of the mobile toothbrush holder 10 with the toothbrush 20 being inserted within.

Further details of the rollers, and other configurations and details of the holder are described in Applicant's PCT patent application PCT/CA2013/050733, filed 26 Sep. 2013 (designating the United States) and published as WO2014/078953 on May 30, 2014, the content of which is hereby incorporated by reference as if fully set forth herein.

While the invention has been shown and described with reference to preferred embodiments thereof, it will be recognized by those skilled in the art that various changes in form and detail may be made therein without departing from the spirit and scope of the invention as defined by the appended claims.

The invention claimed is:

1. A toothbrush holder (10) for holding an individual toothbrush (20) having a head (24) with bristles (24) and a handle (21), the holder (10) comprising:

an enclosure (12) comprising complementary enclosure parts (12A, 12B) articulated relative to one another to separate while receiving said head (24) and come together when said head (24) is stored within said enclosure (12), said enclosure (12) being dimensioned for storing said head (24) while providing a spacing between said bristles (26) and an inner side of the enclosure (12) for hygienic purpose;

a guide member (17) cooperating with said enclosure parts (12A, 12B) for guiding said head (24) during insertion and removal of said head (24) into and out of said enclosure (12); and a biasing member (14) interacting with said enclosure parts (12A, 12B) for biasing said enclosure parts (12A, 12B) to be closed, said guide member (17) facilitating said insertion of said head (24) by forcing said enclosure parts (12A, 12B) to separate against the action of the biasing member (14);

wherein said biasing member (14) comprises a clip connectable to said enclosure parts (12A, 12B) for biasing said enclosure parts together;

wherein said guide member (17) comprises a roller (17A, 17B) mounted on each of said enclosure parts (12A, 12B) for guiding said head (24); and wherein each roller is configured to present a depression to said head (24) for guiding said head (24) between said guide member (17); and wherein the holder (10) comprises a release button (16) to release the clip from said enclosure parts (12A, 12B), said clip comprising a recess (15A) and one of said enclosure parts (12A, 12B) comprises a corresponding protrusion (15B), wherein depressing said release button (16) disengages said protrusion (15B) from said recess (15A) to thereby release the clip from said enclosure parts (12A, 12B).

2. The holder as defined in claim 1, wherein when said head (24) is inserted within said enclosure (12), said guide member (17) and enclosure parts (12A, 12B) being biased by said biasing member (14) retain said head (24) within said enclosure (12) while leaving a portion of said handle (21) outside said enclosure (12).

3. The holder as defined in claim 1, wherein each roller is concavely shaped.

4. The holder as defined in claim 1, wherein said enclosure parts (12A, 12B) are substantially of a similar form.

5. The holder as defined in claim 1, wherein at least one of said enclosure parts (12A, 12B) is configured to have a flat side for wall mounting or for resting on a flat surface.

6. The holder as defined in claim 1, wherein at least one of said enclosure parts (12A, 12B) is configured to have a rounded surface.

7. The holder as defined in claim 1, wherein said enclosure parts (12A, 12B) comprise an interlocking flange (19A) for closing a gap at a parting line between said enclosure parts (12A, 12B).

8. The holder as defined in claim 1, wherein said enclosure parts comprise at least one flange (19B) for closing an opening at an entry or exit of the holder.

9. The holder as defined in claim 1, wherein the biasing member (14) cooperates with said enclosure parts to be releasable from said enclosure parts (12A, 12B) to facilitate disassembly and cleaning of the holder.

10. A toothbrush holder (10) for holding an individual toothbrush (20) having a head (24) with bristles (24) and a handle (21), the holder (10) comprising:

an enclosure (12) comprising complementary enclosure parts (12A, 12B) articulated relative to one another to separate while receiving said head (24) and come together when said head (24) is stored within said enclosure (12), said enclosure (12) being dimensioned for storing said head (24) while providing a spacing between said bristles (26) and an inner side of the enclosure (12) for hygienic purpose;

a guide member (17) cooperating with said enclosure parts (12A, 12B) for guiding said head (24) during insertion and removal of said head (24) into and out of said enclosure (12); and a biasing member (14) interacting with said enclosure parts (12A, 12B) for biasing said enclosure parts (12A, 12B) to be closed, said guide member (17) facilitating said insertion of said head (24) by forcing said enclosure parts (12A, 12B) to separate against the action of the biasing member (14);

wherein said biasing member (14) comprises a clip connectable to said enclosure parts (12A, 12B) for biasing said enclosure parts together, the holder (10) further comprising:

a release button (16) to release the clip from said enclosure parts (12A, 12B), said clip comprising a recess (15A) and one of said enclosure parts (12A, 12B) comprises a corresponding protrusion (15B), wherein depressing said release button (16) disengages said protrusion (15B) from said recess (15A) to thereby release the clip from said enclosure parts (12A, 12B).

11. The holder as defined in claim 1, wherein said guide member (17) is configured to prevent a twisting of said toothbrush head (24) that could lead to contact between said enclosure (12) and said bristles (24) inside said enclosure (12).

* * * * *